US005467554A

United States Patent [19]

Prestele

[11] Patent Number: 5,467,554

[45] Date of Patent: Nov. 21, 1995

[54] GRID PLATE FOR SEEDING DOWN SURFACES

[76] Inventor: Eugen Prestele, Albert-Greiner-Strasse 73, D-86161 Augsburg, Germany

[21] Appl. No.: 176,656

[22] Filed: Jan. 3, 1994

[30] Foreign Application Priority Data

Jan. 7, 1993 [DE] Germany ..... 9300099

[51] Int. Cl.[6] ..... A01G 1/00

[52] U.S. Cl. ..... 47/1.01; 47/33; 404/36

[58] Field of Search ..... 405/258; 47/1 F, 47/33; 404/36, 41, 42; 52/181, 581, 660

[56] References Cited

U.S. PATENT DOCUMENTS

| | | | |
|---|---|---|---|
| 1,905,176 | 4/1933 | Kieckhefer | 47/1 F |
| 2,899,775 | 8/1959 | Partin | 47/1 F |
| 3,922,409 | 11/1975 | Stark | 47/1 F |
| 4,111,585 | 9/1978 | Mascaro | 404/36 |
| 4,596,731 | 6/1986 | Cudmore et al. | 47/1 F |
| 4,621,942 | 11/1986 | Hill | 404/36 |
| 4,671,699 | 6/1987 | Roach | 47/1 F |

FOREIGN PATENT DOCUMENTS

| | | | |
|---|---|---|---|
| 3534078 | 4/1987 | Germany | 47/1 F |
| 3719245 | 12/1988 | Germany | 47/1 F |
| 5023061A | 2/1993 | Japan | 47/1 F |
| 5068438A | 3/1993 | Japan | 47/1 F |
| 7313836 | 4/1975 | Netherlands | 47/1 F |
| 0655830 | 5/1986 | Switzerland | 47/1 F |

*Primary Examiner*—Ramon S. Britts
*Assistant Examiner*—Joanne C. Downs
*Attorney, Agent, or Firm*—Antonelli, Terry, Stout & Kraus

[57] ABSTRACT

A grid plate for seeding surfaces, having cells open at the top comprised of cell walls, each of the cells having openings at the bottom which enable root growth into earth below the grid plate, the cell walls between adjacent cells forming nodal points, wall connections at right angles to the cell walls at the bottom of at least some nodal points each having a range limited to the region of a respective nodal point.

16 Claims, 2 Drawing Sheets

GRID PLATE FOR SEEDING DOWN SURFACES

FIELD OF THE INVENTION

The invention relates to a grid plate for seeding surfaces.

BACKGROUND OF THE INVENTION

Known grid plates for seeding surfaces have cells each having a floor which is provided with an opening that is usually circular in shape. These openings are used, on the one hand, for draining the cells and, on the other hand, to enable root growth into earth below the grid plate. The purpose of the cell floors is to support the grid plate with respect to the earth, which is especially important when vehicles travel over the grid plates.

The openings at the bottom of the known grid plates are, however, not sufficiently large to ensure good rooting of grass with the soil. This results in a hindrance to the growth of the grass, drying out during long dry periods and the possibility of tufts of grass being torn out of individual cells.

In addition, it is also known to provide openings on the cell walls, as a result of which root growth between adjacent cells is possible. Although this increases the hold of the tufts of grass in the individual cells, the other aforementioned disadvantages remain.

SUMMARY OF THE INVENTION

An object of the invention is to enable the grass to form a dense wickerwork of roots under the grid plate, largely unhindered, without thereby appreciably reducing the support load of the grid plate.

This object is achieved by providing a grid plate for seeding surfaces having cells open at the top, the cells being comprised of cell walls. Each of the cells have openings at the bottom which enable root growth into earth below the grid plate, the cell walls between adjacent cells forming nodal points, wall connections at right angles to the cell walls at the bottom of at least some nodal points each having a range limited to the region of a respective nodal point.

BRIEF INTRODUCTION TO THE DRAWINGS

Embodiments of the invention are described in greater detail below, with reference to the drawings, in which.

Figure 1:
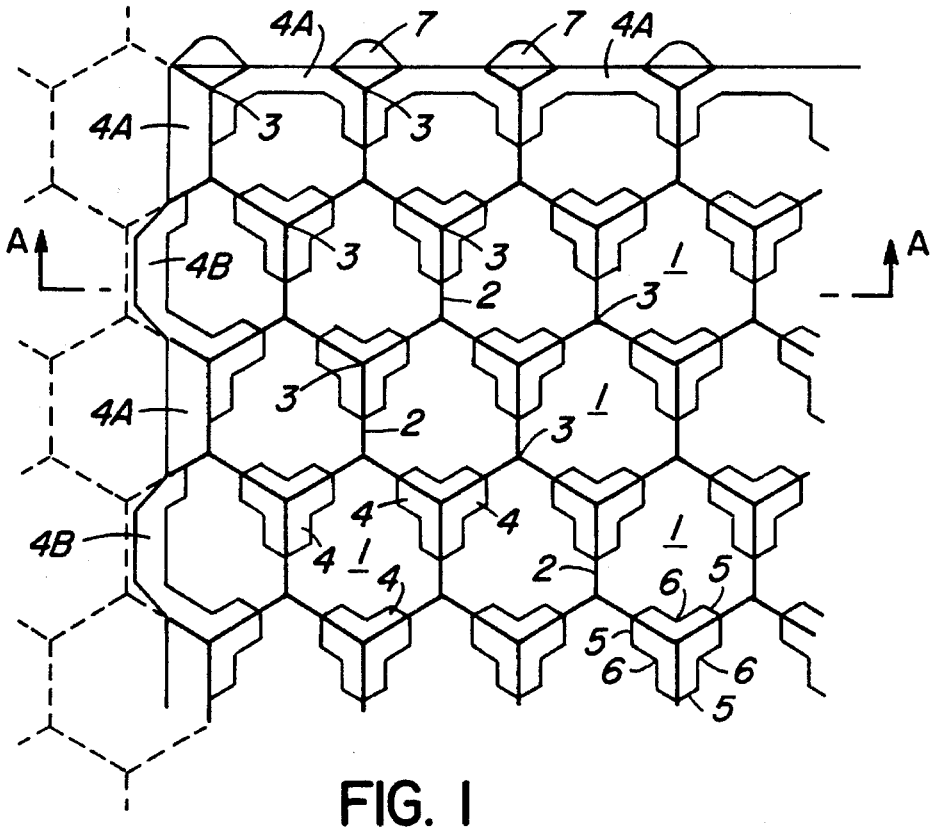
FIG. 1 is a top view of a first embodiment of a grid plate having honeycomb-shaped cells.

Section A–B is a section along line A–B as shown in FIG. 1.

DETAILED DESCRIPTION OF THE INVENTION

The grid plate of FIG. 1 has honeycomb-shaped cells 1. These are formed by cell walls 2 which extend at the nodal points 3 at an angle of 120° to one another. Each cell thus has six nodal points 3. Wall connections 4 forming webs, which extend at right angles to the cell walls 2, are provided at three nodal points 3 of a six nodal point cell.

Figure 2:
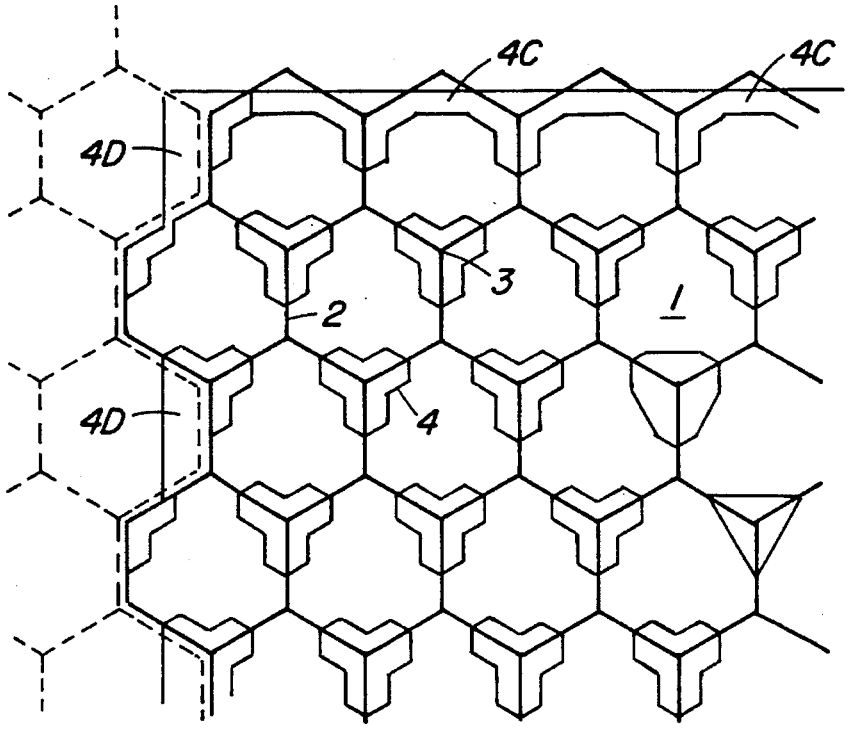
FIG. 2 is a top view of a second embodiment of a grid plate having honeycomb-shaped cells.
Figure 1A:
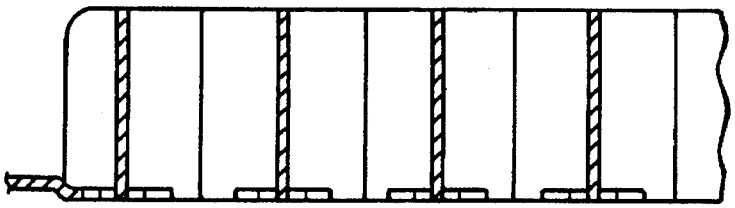
FIG. 1A is a section A—A of FIG. 1.

In the embodiments of FIGS. 1 and 2, the wall connections 4 have a triangular star-shape corresponding to the slope of the cell walls 2 at the nodal points 3. The three arms 5 thus formed, which extend along the walls 2 at the nodal points 3, have a concave-shaped connecting contour 6.

A sufficient support load of the grid plate is ensured by the three wall connections 4 per cell 1, while a large surface is available on the ground to enable root growth with the earth beneath the grid plate.

In the grid plate of FIG. 1, the peripheral cells 1 are cut and made into hexagonal cells with the cut cells of an adjacent grid plate.

Strip-shaped wall connections 4A are provided on the upper edge of the grid plate of FIG. 1 which connect the nodal points 3 there with one another.

Moreover, a projection 7 protruding beyond the contour of the wall connections 4A is formed on and at the bottom at each nodal point. The grid plate adjoining at the top also has strip-shaped wall connections on the periphery which come to rest against the wall connections 4A of the grid plate shown, while the projections 7 come to lie below the grid plate adjoining at the top. This ensures a tooth connection between adjacent grid plates.

In the embodiment on the left edge of the grid plate in FIG. 1, strip-shaped wall connections 4A and 4B are alternately provided in each cell, whereby the strip-shaped wall connections 4B protrude beyond the contour of their cut cells 1. In the assembly of the adjacent grid plate adjoining on the left, their wall connections 4B come to rest against the wall connections 4A of the grid plate adjoining on the right, while the wall connections 4B of the grid plate shown come to lie below the wall connections 4A of the grid plate adjoining on the left. Thus, a tooth connection between adjacent grid plates is also ensured here.

Figure 3:
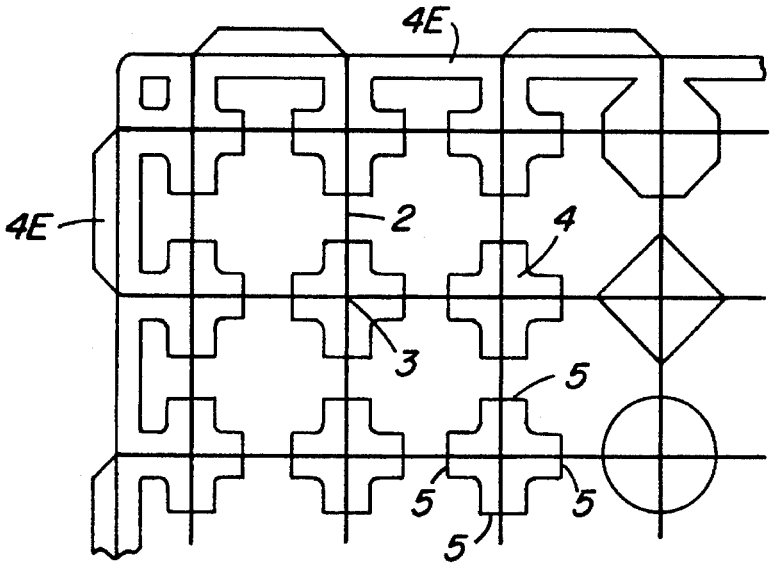
FIG. 3 is a top view of a grid plate with cells having a square cross-section.
Figure 4:
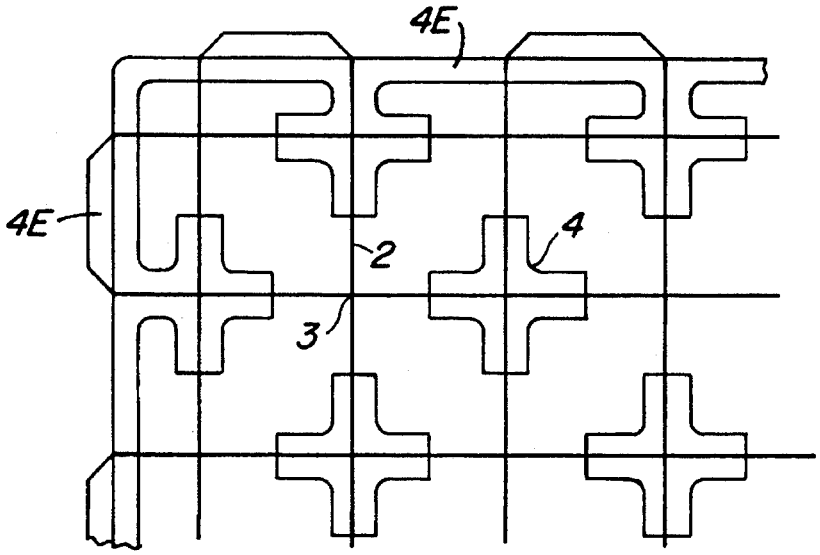
FIG. 4 is a top view of a grid plate with cells having a square cross-section.

In the grid plate in FIG. 2, the peripheral cells also have a full honeycomb shape. A continuous strip-shaped wall connection 4C is provided in the variation of the embodiment on the upper edge of the grid plate in FIG. 2. In the embodiment on the left edge of the grid plate in FIG. 2, a strip-shaped wall connection 4D is disposed in each second cell 1. In the embodiments of FIGS. 3 and 4, the cell walls 2 extend at right angles to one another at the nodal points 3. Accordingly, the wall connections 4 have a star-shape with four arms 5 extending at right angles to one another. While a wall connection 4 is provided at each nodal point 3 in the embodiment of FIG. 3, such wall connections are provided every second nodal point according to the embodiment of FIG. 4. Thus, each cell 1 in FIG. 3 has four wall connections 4, whereas there are only two wall connections per cell in the embodiment of FIG. 4.

Continuous strip-shaped wall connections 4E are provided on the periphery in the two embodiments of FIGS. 3 and 4, whereby this wall connection projects beyond the contour of the cut cell there in every second cell.

The wall connections at the nodal points can also have a circular or rectangular shape, as shown in FIG. 3.

I claim:

1. A grid plate for seeding surfaces, having cells comprised of cell walls open at the top, each of the cells having openings at the bottom which enable root growth into earth below the grid plate, cell walls between adjacent cells forming nodal points, said grid plate further having webs extending at right angles to the cell walls at the bottom of at least some nodal points, said webs having lengths which are a fraction of the lengths of associated cell walls leaving at least a portion of said cell walls having no webs extending therefrom.

2. A grid plate as defined in claim 1, wherein webs, separated from one another, are located at all nodal points.

3. A grid plate as defined in claim 1, wherein a web is located at each alternate nodal point.

4. A grid plate as defined in claim 1, in which the webs have a star-shape corresponding to a slope of the cell walls at the nodal point.

5. A grid plate as defined in claim 4, in which a connecting contour between the arms of star-shaped webs is concave.

6. A grid plate as defined in claim 5 wherein a web projecting beyond a cell contour is provided on every second cell on the periphery of the plate, the webs interlocking with the projecting webs of an adjacent plate.

7. A grid plate as defined in claim 4, wherein webs, separated from one another, are located at all nodal points.

8. A grid plate as defined in claim 4, wherein a web is located at each alternate nodal point.

9. A grid plate as defined in claim 4 wherein a web projecting beyond a cell contour is provided on every second cell on the periphery of the plate, the webs interlocking with the projecting webs of an adjacent plate.

10. A grid plate as defined in claim 1 in which the webs are strip-shaped and are arranged on the periphery of the plate.

11. A grid plate as defined in claim 10, wherein webs, separated from one another, are located at all nodal points.

12. A grid plate as defined in claim 10, wherein a web is located at each alternate nodal point.

13. A grid plate as defined in claim 10 wherein a web projecting beyond a cell contour is provided on every second cell on the periphery of the plate, the webs interlocking with the projecting webs of an adjacent plate.

14. A grid plate as defined in claim 1 wherein a web projecting beyond a cell contour is provided on every second cell on the periphery of the plate, the webs interlocking with the projecting webs of an adjacent plate.

15. A grid plate as defined in claim 14, wherein webs, separated from one another, are located at all nodal points.

16. A grid plate as defined in claim 14, wherein a web is located at each alternate nodal point.

* * * * *